US009816298B2

(12) United States Patent
Derman

(10) Patent No.: US 9,816,298 B2
(45) Date of Patent: Nov. 14, 2017

(54) SECURITY ANCHOR

(71) Applicant: Jay S. Derman, Temecula, CA (US)

(72) Inventor: Jay S. Derman, Temecula, CA (US)

( * ) Notice: Subject to any disclaimer, the term of this patent is extended or adjusted under 35 U.S.C. 154(b) by 0 days.

(21) Appl. No.: 15/470,888

(22) Filed: Mar. 27, 2017

(65) Prior Publication Data

US 2017/0198502 A1 Jul. 13, 2017

Related U.S. Application Data

(62) Division of application No. 15/040,628, filed on Feb. 10, 2016, now Pat. No. 9,603,446.

(60) Provisional application No. 62/249,418, filed on Nov. 2, 2015.

(51) Int. Cl.
*E05B 73/00* (2006.01)
*A47B 21/04* (2006.01)

(52) U.S. Cl.
CPC ..... *E05B 73/0082* (2013.01); *A47B 21/04* (2013.01); *E05B 73/00* (2013.01); *E05B 73/0005* (2013.01)

(58) Field of Classification Search
USPC ..... 248/551, 552; 70/18, 58
See application file for complete search history.

(56) References Cited

U.S. PATENT DOCUMENTS 6,138,975 A * 10/2000 McDaid ..... B61D 45/001 248/499
9,603,446 B1 * 3/2017 Derman ..... A47B 21/04
2003/0094022 A1 * 5/2003 Tan ..... A63C 11/005 70/58

* cited by examiner

*Primary Examiner* — Alfred J Wujciak
(74) *Attorney, Agent, or Firm* — Aaron P. McGushion

(57) ABSTRACT

The present anchor device provides a support for holding a security anchor within a hole, such as a grommet hole, formed through a work surface, such as a table top, a shelf, or other board or sheet. The security anchor has a loop for attaching a lock or receiving a cable lock wrapped about the loop and a cross member to prevent the withdrawal of the security anchor from the grommet hole. The anchor device has a cross member with a dipped portion that supports the loop of the security anchor. The present support device prevents the security anchor from falling down through the hole, while holding the loop of the security anchor just within the hole and within easy grasp of the user.

4 Claims, 5 Drawing Sheets

FIG. 9

SECURITY ANCHOR

RELATED APPLICATION DATA

This application is a divisional of co-pending application Ser. No. 15/040,628 which will issue as U.S. Pat. No. 9,603,446 on Mar. 28, 2017, which, in turn, claims the priority date of provisional application No. 62/249,418 filed on Nov. 2, 2015, each of which is herein incorporated by reference in its entirety.

BACKGROUND

The field of the present device and method relates to lock accessories for fastening objects to a work surface, and more particularly, to lock accessories which insert through a grommet hole through the work surface.

It is often a desire to secure expensive or important items to a particular location, to prevent theft or loss. In a workplace, computers, portable devices, and computer peripherals are commonly locked into place using brackets or cable locks. The cable locks include a lock member attached to the end of a steel cable having a closed loop on the opposite end. The lock member at the end of the cable lock may lock to a security slot formed in the device, such as in a laptop computer, projector, monitor, cash register, money box, gun, rifle, firearm, handcuff, and the like.

One type of lock product compatible with the security slot is made by KENSINGTON and is known as the MICRO-SAVER lock, which is disclosed in U.S. Pat. Nos. 6,081,974, 6,317,936; 6,360,405, 7,204,106, 7,409,842 and U.S. App. Nos. 2011/0179834 and 2011/0122551. Yet another compatible lock is sold by KENSINGTON and is known as the CLICKSAFE lock, which is also disclosed in U.S. Pat. Nos. 7,730,751, 7,963,132, 7,997,106, 8,001,812, 8,042,366, 8,230,707, U.S. App. Nos. 2012/0125057 and 2011/0072863, and U.S. Des. Pat. Nos. D651,889, D660,682, and D661,975.

Other types of lock product compatible with the security slot are patented by the present inventor, Jay Derman, are disclosed in U.S. Pat. Nos. 8,640,511, 8,646,294, 8,726,703, 8,783,073, 8,899,080, and 8,935,943.

The cable lock may then be wrapped about part of a desk, such as the leg, and looped through itself and locked to the object to essentially tie the object to the desk or other difficult to move anchor point. In the case of a laptop or other device that must often be removed from the immediate area, the cable lock may slide off the table and under or behind the desk, requiring the cable lock be retrieved from an inconvenient location. What is needed is a means to hold the cable lock atop the desktop and to provide a convenient anchor for the lock.

SUMMARY

The present support device provides a support for holding a security anchor or lock anchor within a hole, such as a grommet hole, formed through a work surface, such as a table top, a shelf, or other board or sheet. The present support device prevents the security anchor from falling down through the hole, while holding the loop of the security anchor just within the hole and within easy grasp of the user.

A support device is provided for supporting a loop of a security anchor having an anchoring cross member, where the loop is configured to protrude from a grommet hole formed through a work surface with an underside, where the anchoring cross member spans beyond the edge of the grommet hole at the underside to block the security anchor from being pulled through the grommet hole. The support device generally comprises a grommet and a loop supporting cross member extending across the through hole of the grommet.

The grommet has a curved sidewall defining a through hole, where the curved sidewall is sized to fit within the grommet hole to line at least a portion of the grommet hole. The grommet has a first portion across the through hole from a second portion. The grommet further has a flange having a top and extending from the curved sidewall and configured to rest on the work surface to support the grommet within the grommet hole.

The loop supporting cross member extends across the through hole of the grommet, with a first end supported by the first portion and a second end supported by the second portion, and at least a part of the supporting cross member being positioned a depth beneath the flange, where in the depth is sufficiently deep so that when the loop rests on the part of the loop supporting portion the loop is positioned entirely beneath the top of the flange. The loop supporting cross member provides sufficient access to the through hole to permit the routing through of a plurality of device cables. And, the loop of the security anchor can be lifted from the part of the loop supporting cross member for insertion therethrough a lock portion to attach an object to the security anchor.

Optionally, the curved sidewall can be circular and the first portion is diametrically positioned relative to the second portion. The loop supporting cross member can be a rod with a dipped portion formed by bending the rod between the first end and the second end. The dipped portion can be one of a U-bend and a square U-bend.

Again, optionally, the first portion can be a first groove on the flange and the second portion can be a second groove on the flange, where the first end of the loop supporting cross member rests within the first groove and the second end of the loop supporting cross member rests within the second groove, so that the loop supporting cross member can be inserted through loop of the security anchor by lifting one or both of the first end from the first groove and the second end from the second groove.

As an option, the first portion is a first hole in the curved sidewall and the second portion is a second hole in the curved sidewall, with the second hole is formed through the curved sidewall with the first end of the loop supporting cross member rests within the first hole, and the second end of the loop supporting cross member rests within the second hole. The second end of the loop supporting cross member is pushed through the second hole when the grommet is removed from the grommet hole to free the first end from the first hole so that the loop supporting cross member is capable of being inserted through loop of the security anchor by the first end.

Another optional embodiment of the present security anchor support includes a grommet, a loop supporting cross member, and a security anchor. The grommet has a curved sidewall defining a through hole, where the curved sidewall sized to fit within the grommet hole to line at least a portion of the grommet hole. The grommet has a first portion across the through hole from a second portion. And, the grommet has a flange extending from the curved sidewall with a top, and configured to rest on the work surface to support the grommet within the grommet hole. A loop supporting cross member extends across the through hole of the grommet, with a first end supported by the first portion and a second end supported by the second portion, where at least a part of the supporting cross member is positioned a depth beneath the flange. The security anchor includes a loop attached to an anchor member. The loop has a cross-sectional dimension. The security anchor is configured to be inserted through the grommet hole from the underside of the work surface with the anchor member being sized to prevent the security anchor from being pulled through the grommet hole from the top surface; and the loop is configured to be lifted above the top surface for insertion therethrough a lock to attach an object to the security anchor. The depth of the part of the supporting cross member is greater than or equal to the cross-sectional dimension so that when the loop rests on the part of the loop supporting portion the loop is positioned level with or entirely beneath the top of the flange.

Figures 1, 2, 3:
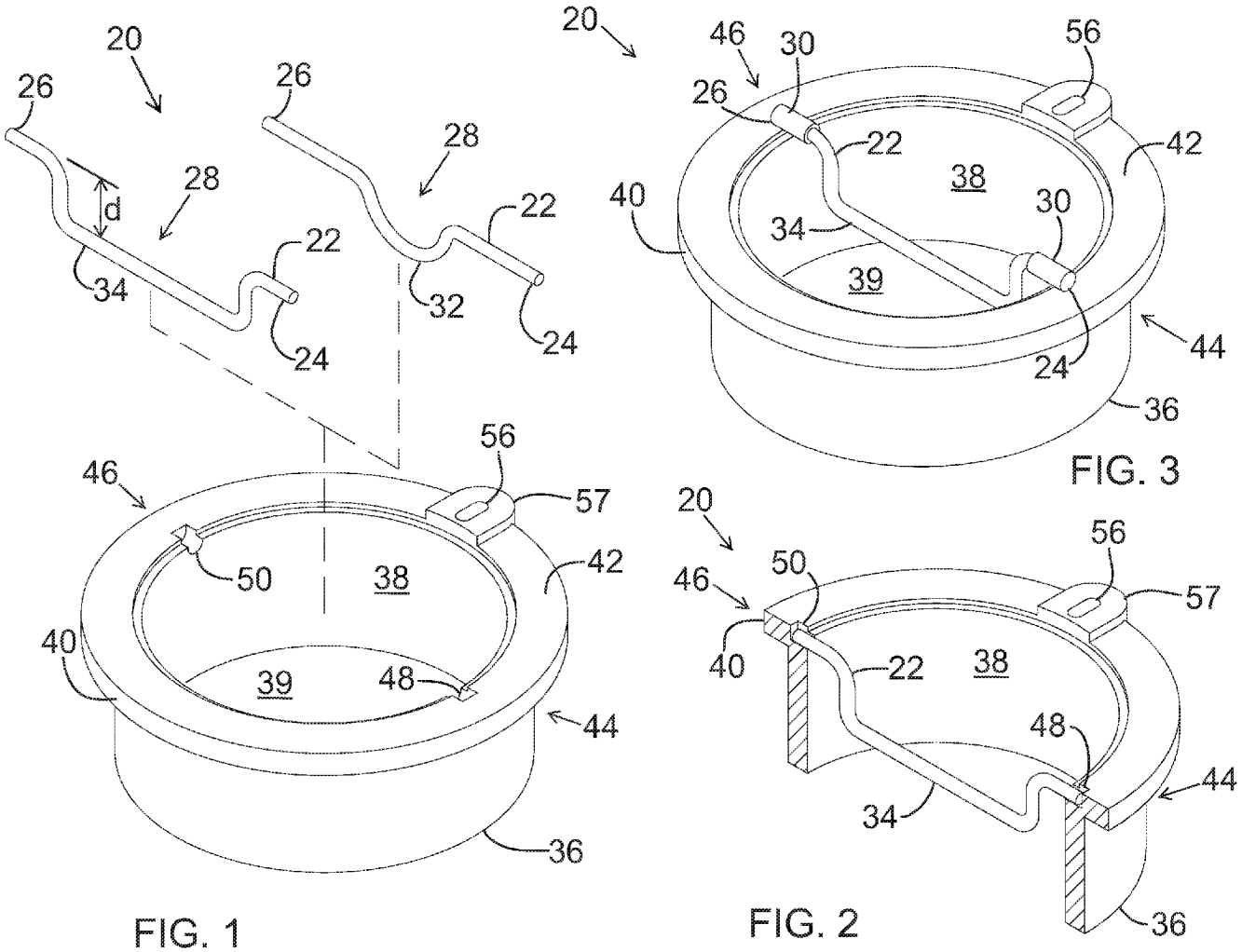
FIG. 1 is an exploded perspective view of the present support device, showing two versions of the loop supporting cross member in position to be placed on the grommet.
FIG. 2 is a cross-sectional perspective view of the embodiment of FIG. 1, showing a loop supporting cross member installed on the grommet.
FIG. 3 is a perspective view of the loop supporting cross member supported by a grommet.

LISTING OF REFERENCE NUMERALS OF FIRST-PREFERRED EMBODIMENT support device 20
loop supporting cross member 22
first end 24
second end 26
dipped portion 28
grip sleeve 30
U-bend 32
square U-bend 34
grommet 36
curved side wall 38
axial hole 39
flange 40
top 42
first portion 44
second portion 46
first groove 48
second groove 50
first hole 52
second hole 54
security slot 56
depth d
security anchor 100
loop 102
anchoring cross member 104
cross-sectional dimension D
work surface 200
grommet hole 202
top surface 204
underside 206
computer 300
peripheral device 302
power/data cable 304
cash register 306
cable lock 400
cable loop 402
cable lock 406
cable loop 408

DESCRIPTION OF THE PREFERRED EMBODIMENTS

The detailed descriptions set forth below in connection with the appended drawings are intended as a description of embodiments, and is not intended to represent the only forms in which the present securement system may be constructed and/or utilized. The descriptions set forth the structure and the sequence of steps for constructing and operating the securement system in connection with the illustrated embodiments. It is to be understood, however, that the same or equivalent structures and steps may be accomplished by different embodiments that are also intended to be encompassed within the spirit and scope of the invention.

FIGS. 1 and 2 illustrate example embodiments of the present anchor device (20), showing two variations of the loop supporting cross member (22). The loop supporting cross members (22) are similarly constructed, except the dipped portion (28) in one loop supporting cross member (22) is a U-bend (32) and the dipped portion (28) in the other loop supporting cross member (22) is a square U-bend (32). The loop supporting cross member (22) can be made of a variety of materials, such as a bent metal rod, as illustrated herein. The dipped portion (28) can be created by a standard wire bending machine, by use of a bending jig, or may be stamped, or other known manufacturing technique. The loop supporting cross member (22) has a first end (24) opposite a second end (26), with the dipped portion (28) formed between. In one example embodiment, the depth (d) of the dipped portion (28) is preferably equal to or greater than the cross-sectional diameter (D) of the loop (102) of the security anchor (100). In other words, it is preferred that the loop (102) be recessed within the grommet (36) to maintain a clean work surface (200 appearance and reduce the possibility of snagging or catching the loop (102). The depth (d) of the dipped portion (28), however, may be less than the cross-sectional diameter (D) of the loop (102), if it is a desire to keep the loop slightly above the top (42) of the grommet (36) flange (40). As will be discussed in greater detail below, the square U-bend (34) may be constructed wider than the U-bend (32) to provide more lateral space for the loop (102) to rest within and to limit the lateral travel of the loop supporting cross member (22) in certain embodiments.

An exemplary grommet (36) is designed to fit within a standard sized grommet hole (202) drilled through a work surface (200), such as a desktop, for routing cables through the desktop. The curved sidewall (38) defines an axial hole (39) formed through the grommet (36). A circular flange (40) with a top (42) extends from the top of the curved sidewall (38). The flange (40) may optionally have a security slot (56) in a reinforced portion (57) of the flange (40) for receiving the CLICKSAFE or MICROSAVER type lock. The user may choose to temporarily lock the CLICKSAFE or MICROSAVER to the security slot (56) to prevent loss of the lock and attached cable when the cable lock (400) is not attached to an object, such as when a laptop is removed from the desk. The security slot (56) could be reinforced to provide a high level of resistance to pulling or breaking to discourage the casual removal of the cable lock (400).

The grommet (36) has a first groove (48) formed on a first portion (44) of the grommet (36), and a second groove (50) formed on a second portion (46) of the grommet (36). In the illustrated example, the grooves (48, 50) are formed partially through the curved sidewall (38) and terminate into the flange (40) at the top (42). The first groove (48) is sized to receive the first end (24) of the loop supporting cross member (22); and the second groove (50) is sized to receive the second end (26) of the loop supporting cross member (22). The grooves (48, 50) may be sized such that the ends (24, 26) must be pressed or snapped into place, being frictionally mechanically held within their respective grooves (48, 50), so that the user can overcome the connection between the ends (24, 26) and the grooves (48, 50) to remove the loop supporting cross member (22) from the grommet (36).

When the loop supporting cross member (22) is detached, wholly or just by one end, the loop (102) of the security anchor (100) can be inserted through the axial hole (39) of the grommet (36) and the loop supporting cross member (22) be inserted through the loop (102). Thereafter, the loop supporting cross member (22) can be snapped back into the grooves (48, 50), trapping the security anchor (100) by the loop (102), preventing it from dropping through the axial hole (39).

FIG. 3 illustrates a variation of the grommet (36) of FIGS. 1-2, where the grooves (48, 50) are eliminated. Instead, the loop supporting cross member (22) has a sleeve (30) over the first end (24) and the second end (26). The sleeve (30) could be made of plastic or rubber, where each end (24, 26) can be dipped into a liquid coating. Optionally, the sleeve (30) can be made of heat-shrink tubing, heated and shrank onto the ends (24, 26). The sleeves (30) provide a gripping action between the loop supporting cross member (22) and the top (42) of the flange (40), and a means to prevent marring as cables and wires move within the grommet (36).

In the example embodiment of FIG. 3, the loop supporting cross member (22) is simply lifted to insert it through the loop (102) of the security anchor (100), and placed back on the top (42) of the flange (40). The square U-bend (34) has a width that is configured to be almost as wide as the axial hole (39) diameter to minimize the lateral travel of the loop supporting cross member (22) within the axial hole (39).

Figure 5:
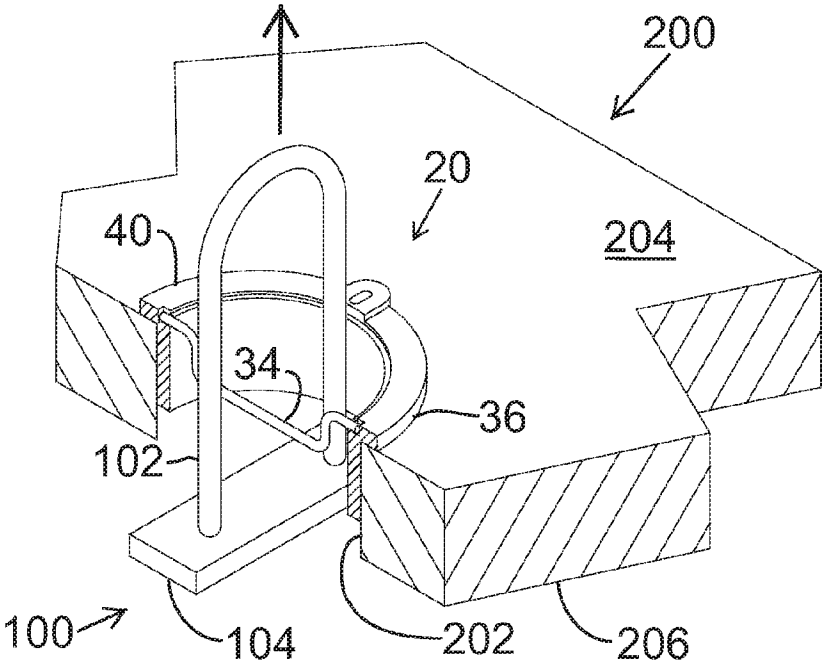
FIG. 5 is a cross-sectional perspective view of the embodiment of FIG. 1, showing a loop supporting cross member installed on the grommet with the loop of the security anchor lifted out of the grommet hole.
Figure 4:
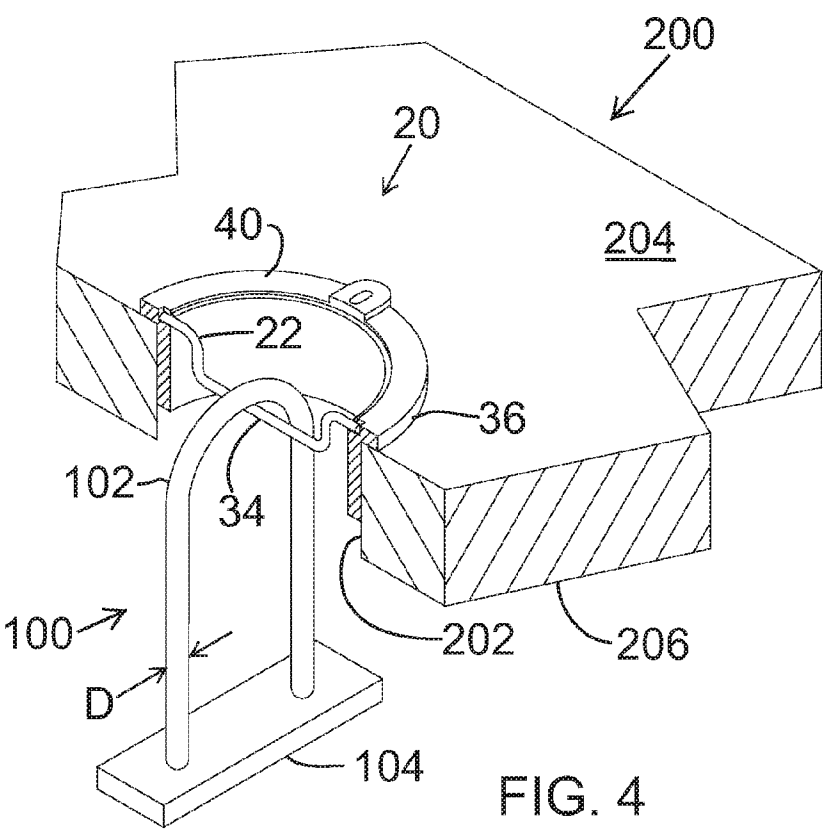
FIG. 4 is a cross-sectional perspective view of the embodiment of FIG. 1, showing a loop supporting cross member installed on the grommet and supporting an security anchor by the loop in a desktop.

FIGS. 4 and 5 illustrate the usage of the embodiment of the anchor device (20) of FIGS. 1 and 2. FIG. 4 illustrates how the present loop supporting cross member (22) holds the loop (102) of the security anchor (100) within the axial hole (39) of the grommet (36). In this example, the loop (102) is a U-shaped shackle bolted or welded to a plate serving as the anchoring cross member (104). The loop (102) rests on the loop supporting cross member (22) at the square U-bend (34), holding the loop (102) just beneath the top surface (204) of the work surface (200) and beneath the top (42) of the flange (40). The anchoring cross member (104), in this case an elongated plate, is sized greater than the grommet hole (202) along at least one dimension such that it cannot fit through the grommet hole (202). In this example, the anchoring cross member (104) is too long to fit through the grommet hole (202). Further, the loop (102) prevents the angling or side-to-side manipulation of the security anchor (100) to pull it though the grommet hole (202).

FIG. 5 shows the security anchor (100) being lifted upwardly in the direction of the arrow, usually by grasping the loop (102), and being blocking from being pulled through the grommet hole (202) by the anchoring cross member (104). In this position, a lock can be wrapped through and about the loop (102) to lock it thereto. Additionally, the shackle of a padlock or the cuff of a pair of handcuffs can be locked through the loop (102). The present anchor device (20) and security anchor (100) leave sufficient space within the axial hole (39) for the threading and arrangement of multiple cables for powering devices and transmitting data.

Figures 6, 7:
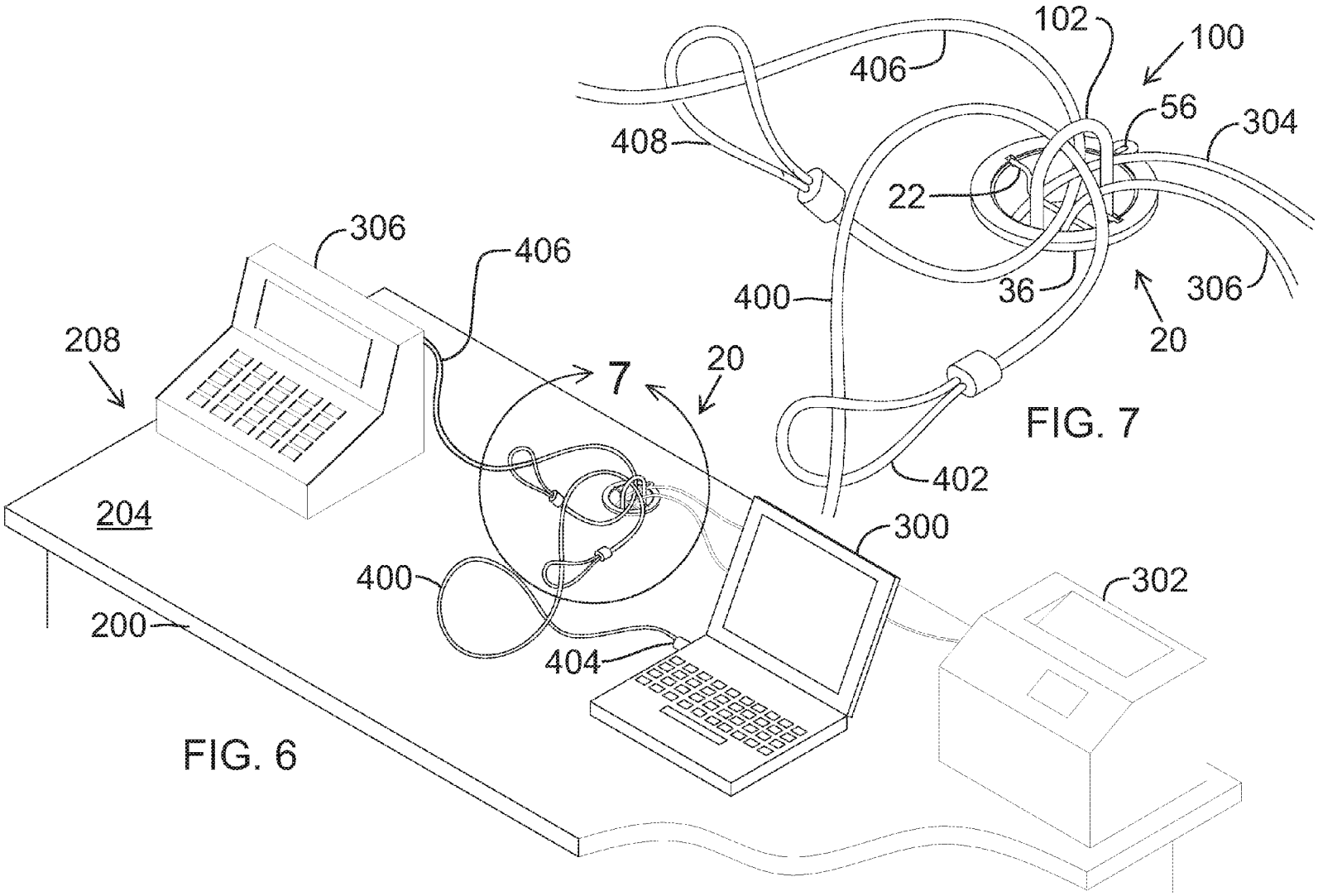
FIG. 6 illustrates an example usage of the present support device, installed within a typical desk with a cable lock threaded through the loop of the security anchor.
FIG. 7 is a partial magnified view of FIG. 6, showing the present support device in greater detail.

FIGS. 6 and 7 illustrate an exemplary desk (208) with a laptop (300) and a printer (302) resting atop the work surface (200). A power cable (304) runs from the printer (302) and through the grommet (36). Similarly, power cable (306) runs from the laptop (300) and also through the grommet (36). A cable lock (400) connects to the laptop (300) by a lock (404), such as the aforementioned MICROSAVER lock system. Before locking the lock (404) to the laptop (300), the lock (404) end of the cable is inserted through the loop (102) of the security anchor (100), then though the cable loop (402), and afterwards, locked to the laptop (300) to secure the laptop (300) to the desk (208).

FIG. 7 more closely shows the cable lock (400) and the second cable lock (406) both threaded through the loop (102) of the security anchor (100). Cable lock (400) is attached to a laptop (300); and cable lock (406) is attached to a cash register (306). Once locked to the laptop (300) or the cash register (306), any upward pulling on the cable lock (400) or cable lock (406), will lift the security anchor (100) upwards and partially out of the grommet (36), with the travel being limited by the anchoring cross member (104) catching on either or both sides of the grommet hole (202) at the underside (206). In this way, the laptop (300) and cash register (306) cannot be removed from the vicinity of the desk (208), without breaking the plastic case of the laptop (300) or the lock portion of the cash register (306). Similarly, the printer (302) (or other device, peripheral device, object, or even a person in the case of a handcuff) can be attached and locked to the security anchor (100). When the laptop (300) is taken to another location, the cable lock (400) can be removed entirely, so that the loop (102) of the security anchor (100) drops into the grommet (36) axial hole (39) and is supported just within the axial hole (39) by the loop supporting cross member (22). FIG. 7 also shows that the present security anchor (100) and loop supporting cross member (22) leave ample room within the axial hole (39) for the various cables routed through the grommet (36).

Figure 9:
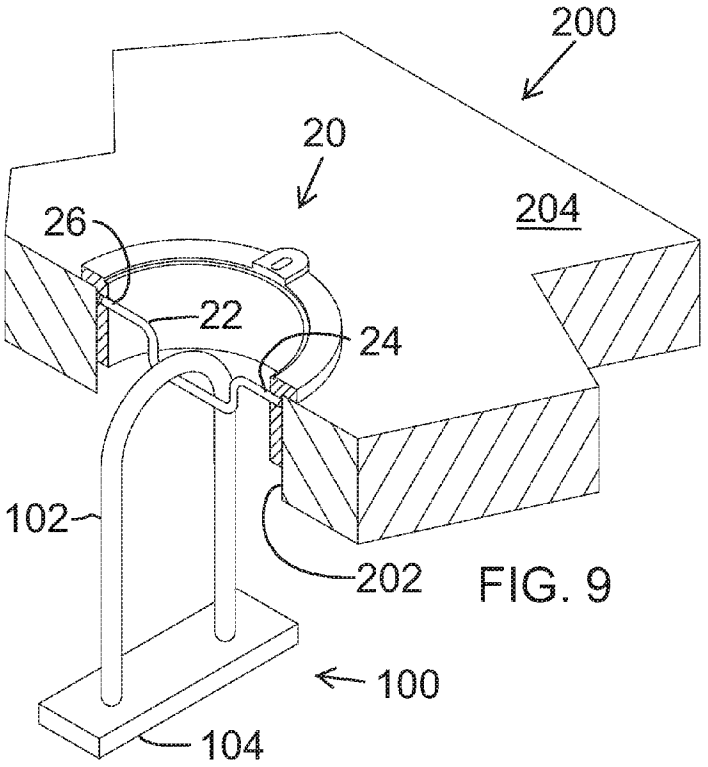
FIG. 9 is a cross-sectional perspective view of the alternate embodiment of FIG. 8, showing a loop supporting cross member installed on the grommet and supporting an security anchor by the loop in a desktop.
Figure 8:
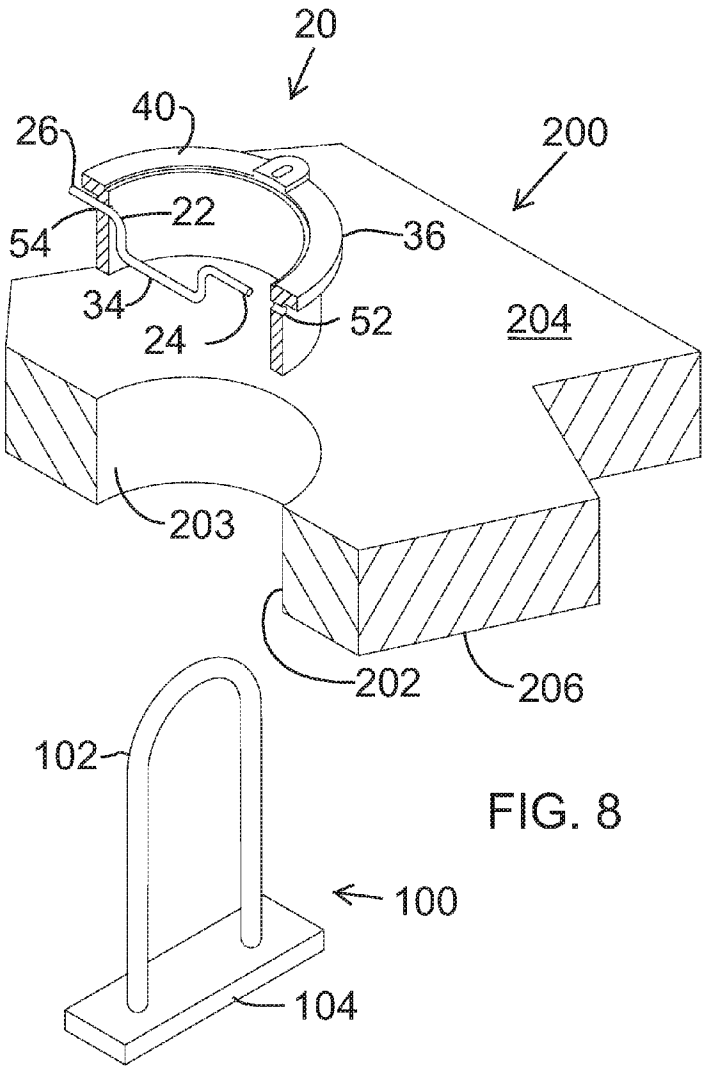
FIG. 8 is an exploded partial cross-sectional perspective view of an alternate embodiment, showing the loop supporting cross member in the open position and ready to receive the loop of the security anchor.

FIGS. 8 and 9 illustrate an alternate embodiment of the present grommet (36) and loop supporting cross member (22). In particular, the grommet (36) has a first hole (52) formed through the curved side wall (38) at the first portion (44) of the grommet (36), and a second hole (54) formed through the curved side wall (38) at the second portion (46) of the grommet (36). The first hole (52) receives and supports the first end (24) of the loop supporting cross member (22). The second hole (54) receives and supports the second end (26) of the loop supporting cross member (22).

When the grommet (36) is lifted from the grommet hole (202), the first hole (52) and the second hole (54) are no longer blocked by the wall (203) of the grommet hole (202), so that the loop supporting cross member (22) can be moved axially with the either hole to free the opposite end. In the illustrated example, the second end (26) is pushed through the second hole (54), pulling the first end (24) out of the first hole (52) freeing the second end (24) from the first hole (52). In this configuration, the loop (102) of the security anchor (100) may be pushed up through the grommet hole (202) and the loop supporting cross member (22) inserted through the loop (102) by the first end (24). The first end (24) of the loop supporting cross member (22) is pushed back into the first hole (52) and the assembly comprising the loop supporting cross member (22), the grommet (36), and the security anchor (100) are fitted back into the grommet hole (202). When fitted in the grommet hole (202), the loop supporting cross member (22) is blocked from withdrawing from the holes (52, 54) by the grommet hole (202) wall (203), as shown in FIG. 9.

Figure 10:
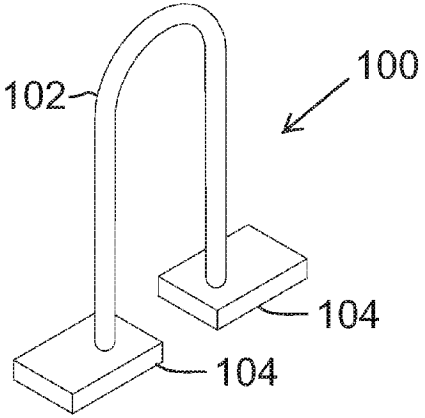
FIG. 10 is a perspective view of one embodiment of the security anchor.

FIGS. 10-14 show several of the many possible designed of the present security anchor (100). In FIG. 10, instead of the single elongated anchoring cross member (104) there are two anchoring cross members (104), one extending from each leg of the loop (102). The loop (102) is not a closed loop, yet can become effectively mechanically closed when locked in position through a grommet (36) by a lock or cable lock (400) incapable of being pulled through the axial hole (39) of the grommet (36). The design of FIG. 10 may also be created by outwardly bending the free end of each leg of the loop (102), creating an omega-shaped profile.

Figure 14:
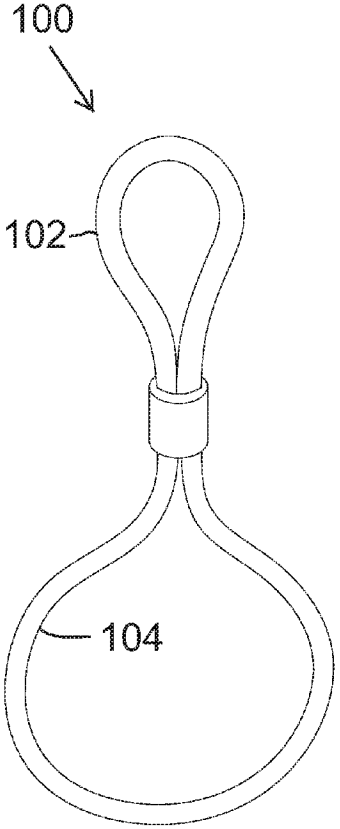
FIG. 14 is a perspective view of one embodiment of the security anchor.
Figure 11:
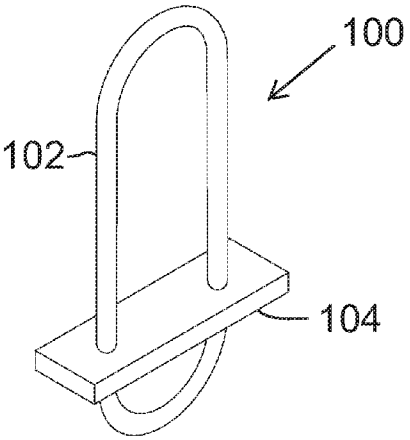
FIG. 11 is a perspective view of one embodiment of the security anchor.
Figure 13:
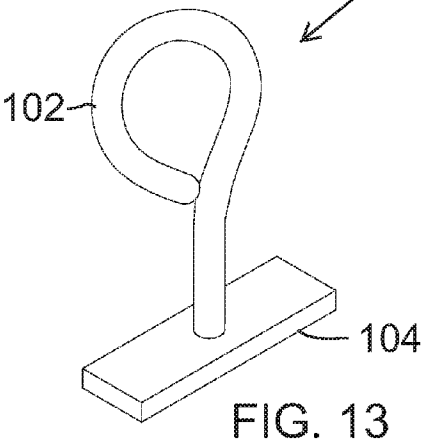
FIG. 13 is a perspective view of one embodiment of the security anchor.
Figure 12:
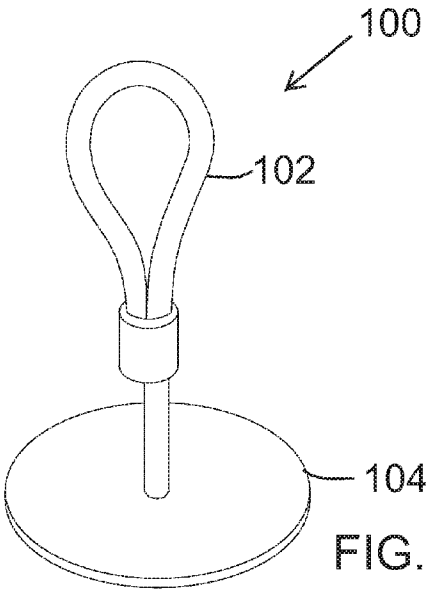
FIG. 12 is a perspective view of one embodiment of the security anchor.

FIG. 11 illustrates an oval-shaped or link-shaped loop (102) that is created by bending a rod and butt welding the ends together after inserting the loop (102) through the anchoring cross member (104). The embodiment of FIG. 12 is created by crimping a loop (102) at one end of a cable and fastening the opposite end of the cable to disk-shaped anchoring cross member (104). FIG. 13 shows an eye bolt fastened to an elongated anchoring cross member (104), where the eye forms a loop (102). And FIG. 14 illustrates a cable crimped to form a figure eight, with the smaller top portion forming the loop (102), where the top portion is able to be fitted through the axial hole (39) of the grommet (36), and the larger bottom portion forms the anchoring cross member (104), because the bottom portion is too large and inflexible to be fitted through the axial hole (39) of the grommet (36).

While particular forms of the present securement system have been illustrated and described, it will also be apparent to those skilled in the art that various modifications can be made without departing from the spirit and scope of the design. Accordingly, it is not intended that the invention be limited except by the claims.

What is claimed is:

1. A support device for supporting a loop of a security anchor having an anchoring cross member, the loop being configured to protrude from a grommet hole formed through a work surface with an underside opposite a top side, the anchoring cross member spanning the grommet hole at the underside to block the security anchor from being pulled through the grommet hole, the support device comprising:

a grommet with a curved sidewall defining a through hole, the curved sidewall sized to fit within the grommet hole to line at least a portion of the grommet hole, the grommet having a first sidewall hole a second sidewall hole, the first sidewall hole across the through hole from the second sidewall hole, the grommet having a flange extending from the curved sidewall and having a top and configured to rest on the work surface to support the grommet within the grommet hole; and a loop supporting cross member extending across the through hole of the grommet, with a first end supported by the first sidewall hole and a second end supported by the second sidewall hole, at least a part of the supporting cross member being positioned a depth beneath the flange, the depth being sufficiently deep so that when the loop rests on the part of the loop supporting portion the loop is positioned entirely beneath the top of the flange;

wherein the grommet is removable from the grommet hole, the first end of the loop supporting cross member rests within the first sidewall hole, and the second end of the loop supporting cross member rests within the second sidewall hole, wherein the second end of the loop supporting cross member is pushed through the second sidewall hole when the grommet is removed from the grommet hole to free the first end from the first hole so that the loop supporting cross member is capable of being inserted through loop of the security anchor by the first end;

and wherein the loop supporting cross member provides sufficient access to the through hole to permit the routing of a plurality of device cables through the work surface from the top side to the underside;

and wherein the loop of the security anchor can be lifted from the part of the loop supporting cross member for insertion therethrough a lock portion to attach an object to the security anchor.

2. The support device of claim 1 wherein the sidewall is circular and the first sidewall hole is diametrically positioned relative to the second sidewall hole.

3. The support device of claim 1 wherein the loop supporting cross member is a rod and the part is a dipped portion formed by shaping or bending the rod between the first end and the second end.

4. The support device of claim 3 wherein the dipped portion is one of a U-bend and a square U-bend.

* * * * *